US010314399B2

(12) United States Patent
Wolle et al.

(10) Patent No.: US 10,314,399 B2
(45) Date of Patent: Jun. 11, 2019

(54) STORAGE CONTAINER

(71) Applicant: TTS Tooltechnic Systems AG & Co. KG, Wendlingen (DE)

(72) Inventors: Lutz Wolle, Burlafingen (DE); Markus Barabeisch, Vohringen (DE)

(73) Assignee: TTS TOOLTECHNIC SYSTEMS AG & CO. KG, Wendlingen (DE)

( * ) Notice: Subject to any disclaimer, the term of this patent is extended or adjusted under 35 U.S.C. 154(b) by 0 days.

(21) Appl. No.: 15/746,997

(22) PCT Filed: Jul. 24, 2015

(86) PCT No.: PCT/EP2015/066978

§ 371 (c)(1),
(2) Date: Jan. 23, 2018

(87) PCT Pub. No.: WO2017/016574

PCT Pub. Date: Feb. 2, 2017

(65) Prior Publication Data

US 2018/0213934 A1 Aug. 2, 2018

(51) Int. Cl.
*A47B 88/90* (2017.01)
*B25H 3/02* (2006.01)
(Continued)

(52) U.S. Cl.
CPC ..... *A47B 88/90* (2017.01); *B25H 3/021* (2013.01); *E05B 65/46* (2013.01); *A47B 88/57* (2017.01); *A47B 2210/19* (2013.01); *B25H 3/028* (2013.01)

(58) Field of Classification Search
CPC ..... A47B 88/90; A47B 88/57; A47B 2210/19; B25H 3/028; B25H 3/02; B25H 3/06; B25H 3/21; E05B 65/46
(Continued)

(56) References Cited

U.S. PATENT DOCUMENTS 1,984,345 A * 12/1934 Kennedy ..... B25H 3/02 206/373
3,203,744 A * 8/1965 Batke ..... A47B 47/04 312/108
(Continued)

FOREIGN PATENT DOCUMENTS

CH 576244 6/1976
DE 2132126 6/1971
(Continued)

*Primary Examiner* — Janet M Wilkens
(74) *Attorney, Agent, or Firm* — Hoffmann & Baron, LLP

(57) ABSTRACT

A storage container that has a container housing in which at least one receiving compartment is formed, and a drawer element which can be pulled out and retracted is located in the receiving compartment. Pull out-limiting means prevent the drawer element from being accidentally pulled out beyond a maximum pull-out operating position. The pull out-limiting means have stop tongues which can be pivoted against lateral outer wall sections of the drawer element by means of elastic deformation and each of which includes a stop protrusion that protrudes outwards. A counter stop edge which is arranged on the container housing is located in the pull-out path of each stop protrusion. If the drawer element is pulled out completely, the stop tongues can be bent by being manually acted upon such that the respective stop protrusion can pass by the counter stop edge.

18 Claims, 8 Drawing Sheets

(51) Int. Cl.
*E05B 65/46* (2017.01)
*A47B 88/57* (2017.01)

(58) Field of Classification Search
USPC .... 220/4.26–4.28, 4.31, 4.33; 206/372, 373; 312/902, 107, 108, 111, 330.1, 333, 290
See application file for complete search history.

(56) References Cited

U.S. PATENT DOCUMENTS

| | | | | |
|---|---|---|---|---|
| 5,016,946 | A * | 5/1991 | Reznikov | A47B 87/02 312/108 |
| 5,544,751 | A | 8/1996 | Klodt et al. | |
| 5,603,559 | A | 2/1997 | Yemini | |
| 7,661,553 | B2 * | 2/2010 | Zeiron | A47K 10/427 221/305 |
| 2002/0125159 | A1 | 9/2002 | Hann | |
| 2011/0075330 | A1 * | 3/2011 | Kuo | G02F 1/133308 361/679.01 |
| 2012/0181904 | A1 * | 7/2012 | Ma | A47B 67/04 312/108 |
| 2012/0326406 | A1 * | 12/2012 | Lifshitz | B25H 3/02 280/47.19 |
| 2015/0043152 | A1 * | 2/2015 | Zhang | G11B 33/124 361/679.37 |

FOREIGN PATENT DOCUMENTS

| | | | |
|---|---|---|---|
| DE | 7222173 | | 9/1972 |
| DE | 8913752 | | 2/1990 |
| DE | 29719059 | | 12/1997 |
| DE | 202009018589 | | 5/2012 |
| DE | 102012107955 | | 3/2014 |
| EP | 1658160 | | 5/2008 |
| WO | 9612424 | * | 5/1996 |
| WO | 2017016573 | * | 2/2017 |
| WO | 2017016581 | * | 2/2017 |

* cited by examiner

STORAGE CONTAINER

BACKGROUND OF THE INVENTION

This application claims priority based on an International Application filed under the Patent Cooperation Treaty, PCT/EP2015/066978, filed Jul. 24, 2015.

The invention relates to a storage container comprising a container housing provided with at least one reception compartment open at a compartment opening on a front side of the container housing and with a drawer element arranged in the reception compartment in a manner allowing to be pulled out of and to be pushed into the reception compartment in a longitudinal direction of the container housing, wherein the drawer element, in order to form a drawer interior, has a base wall and an outer wall projecting upwards from the base wall and having two lateral outer wall sections located opposite each other at a distance in a transverse direction—perpendicular to the longitudinal direction—of the container housing, and further comprising pull-out limiting means for limiting the pulling-out of the drawer element from the reception compartment.

Such a storage container is known from U.S. Pat. No. 5,603,559. This known storage container has a container housing which forms several reception compartments arranged on top of one another in a height direction, in each of which a drawer element capable of being pulled out of and pushed into a reception compartment in a longitudinal direction of the container housing coinciding with its depth direction is located. For operation, each drawer element has a handle facilitating easy entry in the region of the compartment opening of the reception compartment on the front side of the container housing. In order to prevent the accidental excessive pulling-out of the drawer element, the storage container is provided with pull-out limiting means having a stroke limiting stop located on the upper edge of the rear outer wall section of the drawer element, to which stop is assigned a counter-stop formed in the region of the compartment opening on the top side of the reception compartment. The drawer element can be pulled out of the reception compartment until its stroke limiting stop hits the counter-stop on the housing. This arrangement has the disadvantage that the drawer element, if it needs to be removed completely from the reception compartment, has to be raised in the region of its front side to disengage the stroke limiting stop from the counter-stop. As a result of the tilting of the drawer element involved in this process, the parts in the drawer interior can shift or even fall out of the drawer interior.

From EP 1 658 160 B1, a storage container is known which is composed of a plurality of housing modules placed on top of one another in a height direction and latched together in pairs. Housing modules which are adjacent to one another in the height direction in each case together bound a reception compartment which is open towards the front side of the container housing and in which a drawer element is located in a pull-out and push-in arrangement.

From U.S. Pat. No. 5,544,751, too, a storage container is known which comprises a plurality of housing modules sitting on top of one another vertically and latched together while bounding a reception compartment for a drawer element in pairs.

DE 10 2012 107 955 A1 discloses a container with a base wall, two left-hand and right-hand side walls and a rear wall, it being possible to stack several such containers on top of one another and to latch them together. Each container can accommodate a pull-out drawer.

In DE 20 2009 018 589, a container assembly is disclosed, which is composed of a plurality of stackable containers which can be coupled vertically by means of a cabinet lock.

U.S. Pat. No. 3,316,045 and US 2002/0125159 A1 describe storage containers with a one-part carcass, in which several drawers are located in a pull-out arrangement and which has on its top side an opening closed by means of a pivotably mounted cover plate.

SUMMARY OF THE INVENTION

The invention is based on the problem of providing measures for completely removing in a simple way a drawer element limited in its pull-out movement from a reception compartment of a container housing.

To solve this problem, it is provided, in combination with the features mentioned above, that the pull-out limiting means comprise a stop tongue at each of the two lateral outer wall sections of the drawer element which can be pivoted by elastic deformation in the transverse direction of the container housing and which has at least one stop projection projecting in the transverse direction from the drawer interior towards the outside, and that at the container housing there is provided in each of the two lateral edge regions of the compartment opening a counter-stop edge located in the pull-out path of one of the stop projections, against which counter-stop edge the associated stop projection can run while the drawer element is pulled out in order to preset the maximum pulled-out operating position, wherein the stop tongues can be pivoted reversibly inwards towards the drawer interior into a release position by the application of manual force in order to enable the complete removal of the drawer element from the reception compartment.

In this way, the accidental excessive pulling-out of the drawer element from the associated reception compartment is effectively prevented in the normal use of the storage container. The pull-out limiting means predetermine the maximum pulled-out operating position of the drawer element by providing that the stop projection on the stop tongue runs against the housing-mounted counter-stop edge located in its pull-out path in the region of the drawer opening. Relative to the longitudinal direction of the drawer element, the stop tongue is preferably placed such that the drawer element maintains a stable horizontal position in the maximum pulled-out operating position and does not tilt downwards. If the drawer element has to be removed completely from the reception compartment at one point, for example on order to carry it to a place of work with its content, or in order to merely clean it, the stop tongues can, for example with a finger of each hand, be pushed inwards towards the drawer interior, so that the stop projections are pushed out of the collision range with the counter-stop edges. In this state, the drawer element can be completely pulled out of the reception compartment, and the stop projections can pass the associated counter-stop edges. When subsequently released, the stop tongues spring back from the release position into their home position, which can also be described as limiting position, owing to their elastic deformation. For re-inserting the drawer element into the reception compartment, the stop tongues are once again pivoted into the release position, which can be done either directly manually or preferably by providing that the stop tongues, when contacting the container housing, are automatically pivoted into the release position for a short time. As the drawer element can be held in a horizontal position both during removal and during re-insertion, the contents of the drawer are not affected by these operations.

Advantageous further developments of the invention emerge from the dependent claims.

The stop tongues are preferably placed at the lateral outer wall sections in such a way that they come to lie outside the reception compartment with a section of their length in the maximum pulled-out operating position of the drawer element. In this section of their length, they can comfortably be operated manually for pivoting from the non-deformed home position into the release position.

The counter-stop edges fixed in place on the container housing are expediently formed on boundary wall sections of the container housing, which bound the compartment opening of the reception compartment at the sides oriented in the transverse direction. In this way, the wall of the container housing can be used directly to form the counter-stop edge.

It is furthermore advantageous if the stop projections are designed to be barb-shaped at their rear side oriented in the pull-out direction of the drawer element, wherein the resulting inclined rear stop face comes to lie opposite a counter-stop face of a counter-stop edge oriented with a corresponding inclination. As the drawer element is pulled out, the inclined stop faces come into contact with the likewise inclined counter-stop faces, so that the stop projections get locked to the counter-stop edges and a pulling-out of the drawer element from the reception compartment is prevented even under a very strong tensile force. In this way, the pivoting of the stop tongues into the release position can be effectively avoided even if the drawer element is pulled with inappropriate strength.

At their front side pointing in the push-in direction of the drawer element, the stop projections are expediently provided with an inclined sliding surface which is oriented such that it increasingly diverges from the drawer interior in the pull-out direction of the drawer element. These sliding surfaces facilitate the re-insertion of the drawer element into the reception compartment, because they make a direct manual pressure on the stop tongue for pivoting it into the release position unnecessary. When the drawer element is inserted into the reception compartment, the sliding surfaces come into contact with counter-stop bodies fixed to the container housing, on which they slide while simultaneously being pivoted towards the drawer interior under elastic deformation. The counter-stop bodies at the same time expediently define the counter-stop edges acting to limit the pull-out movement.

It would, for example, be possible to place the stop tongues in such a way that they project beyond the outline of the lateral outer wall sections of the drawer element at the rear. It is, however, more advantageous if they are placed within the outline of the respectively associated lateral outer wall section, because in this way they do not affect the compartment depth of the reception compartment required for accommodating the drawer element.

A variant in which each of the stop tongues is located in a wall opening of the associated lateral outer wall section of the drawer element is deemed particularly expedient. Irrespective of their mounting location, it is in any case advantageous if the stop tongues are designed in one piece with the associated lateral outer wall section. The lateral outer wall section is preferably made of a plastic material, like the stop tongues.

Each stop tongue is preferably designed such that it has an oblong support arm which is joined to the associated lateral outer wall section in a transition region in one piece and elastically flexible and which supports the stop projection, which is preferably formed in one piece with the support arm, at a point which is distant from the transition region. The stop projection is in particular located in a free end region of the support arm opposite the transition region between the support arm and the lateral outer wall section. It is advantageous if the support arm as a whole is elastically flexible in the section of its length between the transition region and the stop projection.

For the easy operation of the stop tongues, it is advantageous if the support arm of the stop tongue has on the outside remote from the drawer interior a raised operating structure, such as a fluted raised area. In this way, the user of the storage container can visualise the optimum force introduction area for operating the stop tongues.

The stop tongues are preferably oriented such that they extend from the transition region to the lateral outer wall section in the insertion direction of the drawer element.

If the stop tongues are located in a wall opening of the lateral outer wall section, it is advantageous if their support arm extends in a common plane with the lateral outer wall section and only the stop projection projects beyond the wall outer surface of the lateral outer wall section, which is remote from the drawer interior. In this way, the stop tongue can be realised in the manner of a punching within the contour of the lateral outer wall section. It is nevertheless preferably produced, together with the entire drawer carcass, by injection-moulding a plastic material.

On the outside—remote from the drawer interior—of a front outer wall section assigned to the compartment opening, each drawer element is expediently provided with a handle which can be used for pulling out and for holding in the fully pulled-out state.

The storage container is preferably designed to be portable. For easy transport, it expediently has at least one carrying handle which is preferably located on the top side at the outside of the container housing. During transport, the drawer element is preferably inserted fully into the associated reception compartment. Locking means which facilitate a releasable locking of each drawer element to the housing if fully inserted into the associated reception compartment are preferably provided.

The base wall of the drawer element is expediently plate-shaped. The outer wall of the drawer element expediently projects upwards from the outer edge region of the base wall, extending around the base wall.

The drawer element is preferably designed without a cover. It is, however, easily possible to provide the drawer element with a removable or pivotable cover with which the drawer interior can be covered on its top side. In this context, it is also possible to design the drawer element in the manner of a case-type container, for example as a shell case.

The container housing of the storage container can be designed such that it defines only a single reception compartment for a drawer element. If a larger storage volume usable in various ways is to be made available, however, it is advantageous if several reception compartments arranged on top of one another in the height direction of the container housing are formed in the container housing, each of them accommodating its own drawer element, wherein pull-out limiting means as described are assigned to each of these drawer elements.

The container housing can be designed in one piece at least in the region which defines the at least one reception compartment. To produce storage containers with different storage volumes in a cost-effective way, however, it is advantageous if the container housing has a modular structure and is composed of a plurality of housing modules arranged on top of one another in the height direction of the container housing and coupled to one another in pairs in a way which prevents lifting off, wherein two housing modules arranged immediately on top of each other in each case jointly define a reception compartment for a drawer element. For the paired coupling of the housing modules, latching connection devices are expediently provided; these can be releasable in principle, but are preferably of a non-releasable design, so that they are capable of clamping the housing modules together permanently in the height direction without play.

In this modular structure, it is not mandatory but advantageous if at least one or else each of the reception compartments is bounded by a compartment side wall which is jointly composed of an upward-projecting upper module side wall of a lower housing module and a downward-projecting lower module side wall of the housing module placed immediately above.

If several reception compartments arranged on top of one another in the storage container are to be realised, it is advantageous if at least one or else each of the housing modules located between two reception compartments is designed as a housing intermediate module having a module horizontal wall extending between the two reception compartments at right angles to the height direction of the container housing and an upward-projecting upper module side wall integrally formed in one piece to the edge of the module horizontal wall as well as a lower module side wall integrally formed in one piece to the edge of the module horizontal wall and projecting beyond the module horizontal wall in the downward direction. In this way, the housing intermediate module contributes to the formation of both a compartment side wall bounding the reception compartment placed above and a compartment side wall bounding the reception compartment placed below.

BRIEF DESCRIPTION OF THE DRAWINGS

The invention is explained in greater detail below with reference to the enclosed drawing, of which.

DETAILED DESCRIPTION OF THE PREFERRED EMBODIMENTS

Figure 1:
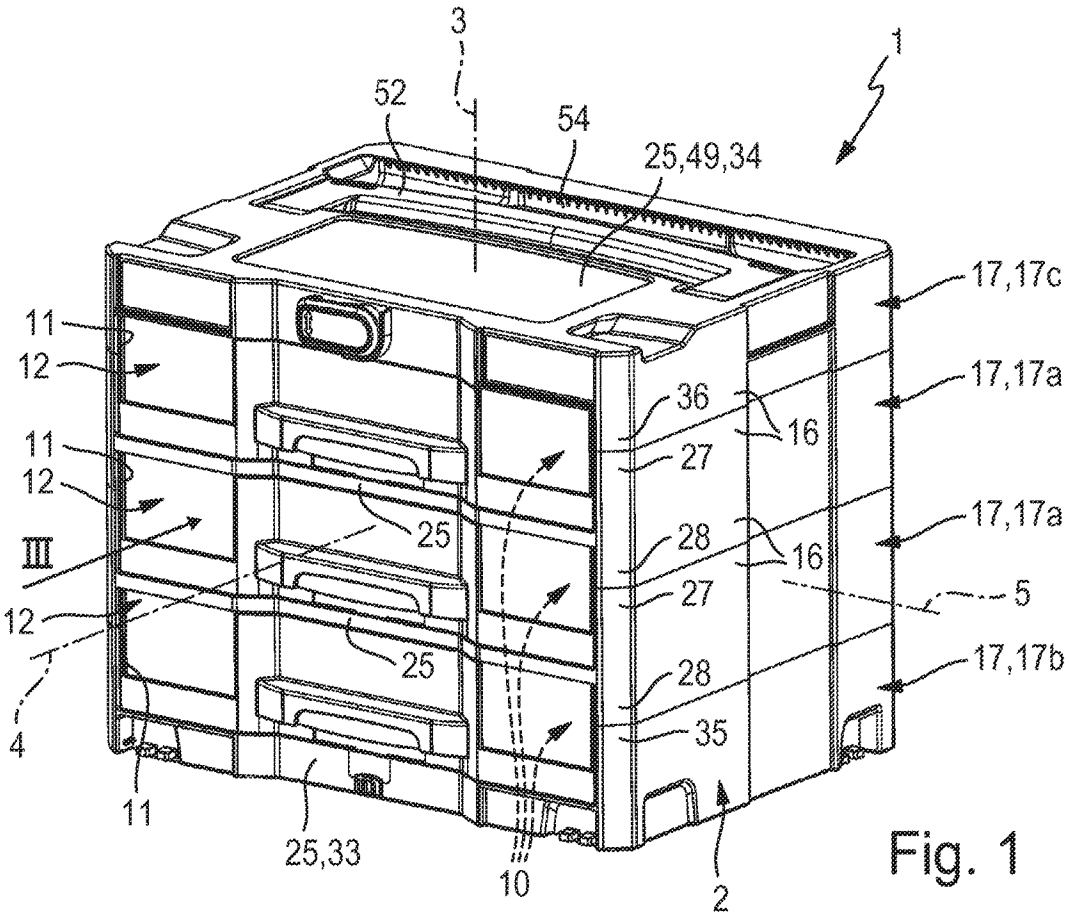
FIG. 1 is a perspective view of a preferred embodiment of the storage container according to the invention, the storage container having a plurality of reception compartments, each provided with a drawer element.

FIGS. 4, 5, 6 and 8 each show a region of the storage container framed by dot-dash lines, occasionally isolated and enlarged.

The storage container, which is identified by the reference number 1 in its entirety, has a container housing 2 with a vertical axis 3, the axial direction of the vertical axis 3 being hereinafter also referred to as the height direction 3.

The container housing 2 further has a longitudinal axis 4 perpendicular to the vertical axis 3 and a transverse axis 5 perpendicular to the vertical axis 3 and the longitudinal axis 4. The axial direction of the longitudinal axis 4 is hereinafter also referred to as the longitudinal direction 4, and the axial direction of the transverse axis 5 is also referred to as the transverse direction 5 of the container housing 2. The dimensions in the longitudinal direction 4 define the depth of the container housing 2, while the dimensions in the transverse direction 5 define its width.

In the usual position of use of the storage container 1, the vertical axis 3 is oriented vertically and the longitudinal axis 4 and the transverse axis 5 are oriented horizontally.

In a plane perpendicular to the vertical axis 3 the container housing 2 preferably has an at least substantially rectangular outline. As a whole, the container housing 2 preferably has a cuboid basic structure.

The container housing 2 has a front side 6 oriented in the axial direction of the longitudinal axis 4 and a rear side 7 oriented oppositely thereto. The container housing 2 further has two lateral outsides 8, 9 oriented opposite each other in the axial direction of the transverse axis 5.

The container housing 2 bounds at least one reception compartment 10 and preferably a plurality of reception compartments 10, which are arranged on top of one another in the height direction 3. In the illustrated embodiment, three reception compartments 10 are provided, but any number can be involved in principle. The storage container 1 can also be provided with one reception compartment 10 only.

Each reception compartment 10 is accessible from the outside through its own compartment opening 11, which is located on the front side 11 and cut out of the container housing 2. In each reception compartment 10 there is provided a drawer element 12, which can be pulled out of the associated reception compartment 10 in a pull-out movement 13*a* and pushed into the respective reception compartment 10 in an opposite push-in movement 13*b*. The two movements 13*a*, 13*b* are indicated by arrows.

The movement direction of the pull-out movement 13*a* will hereinafter also be referred to as pull-out direction 13*a*. The movement direction of the push-in movement 13*b* will hereinafter also be referred to as push-in direction 13*b*.

Figure 2:
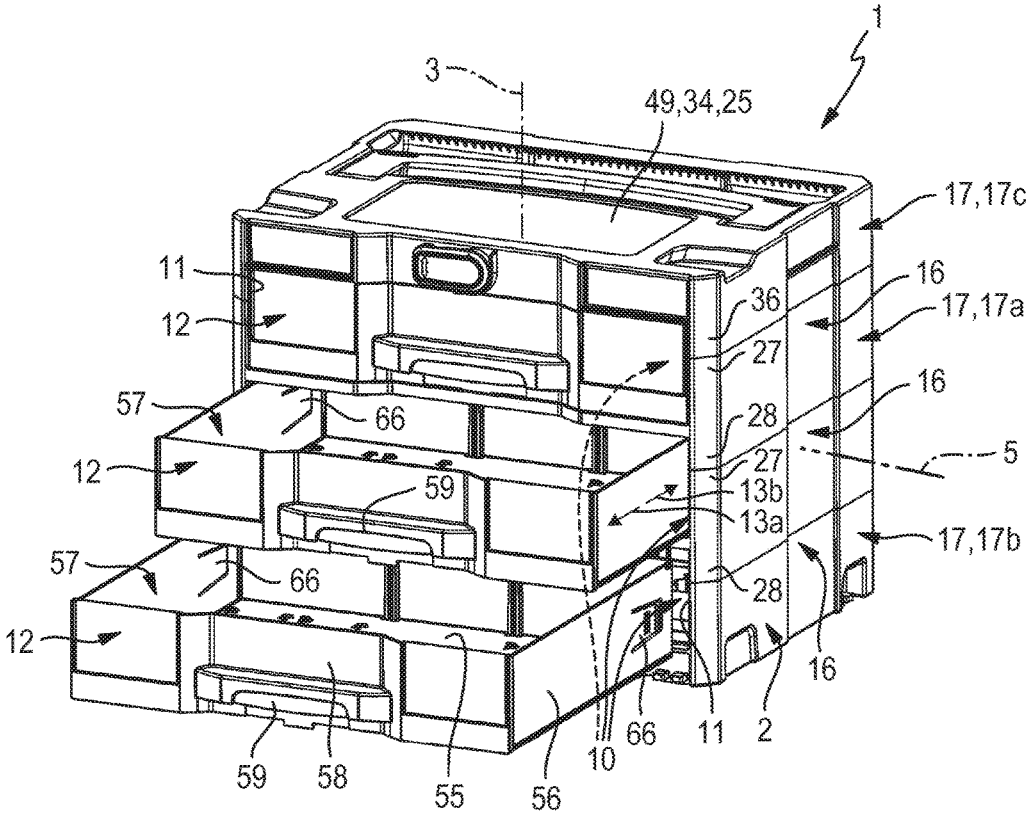
FIG. 2 shows the storage container from FIG. 1 with drawer elements pulled out to different degrees.
Figure 3:
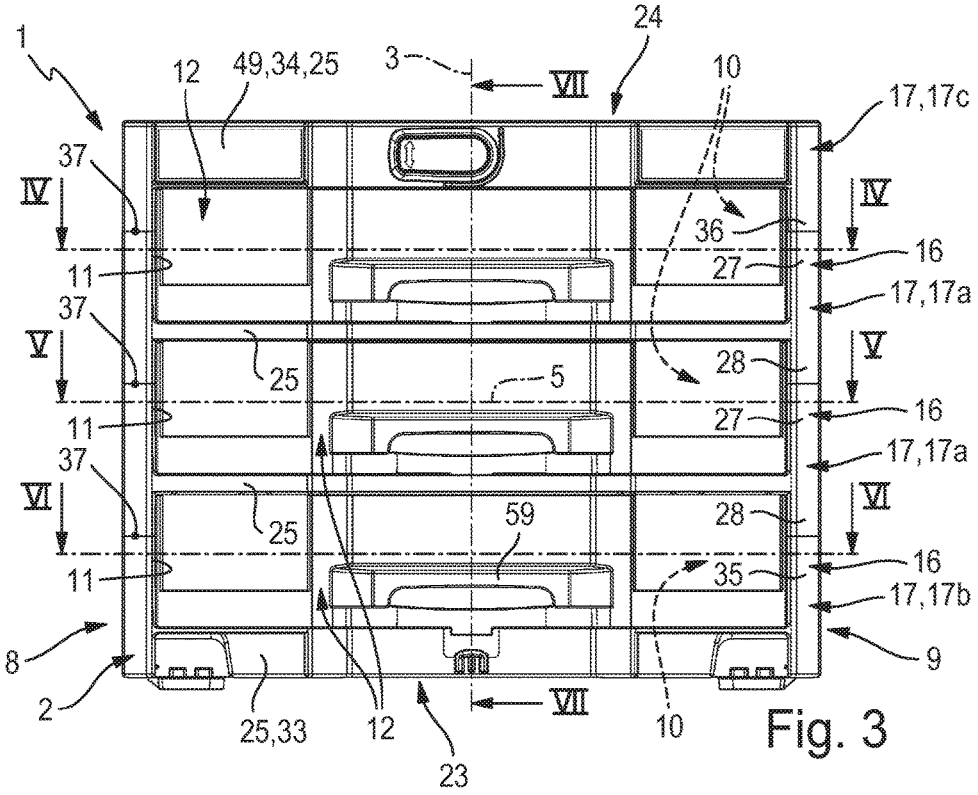
FIG. 3 is a front view of the storage container from FIGS. 1 and 2 in the direction according to arrow III from FIG. 1.
Figure 4:
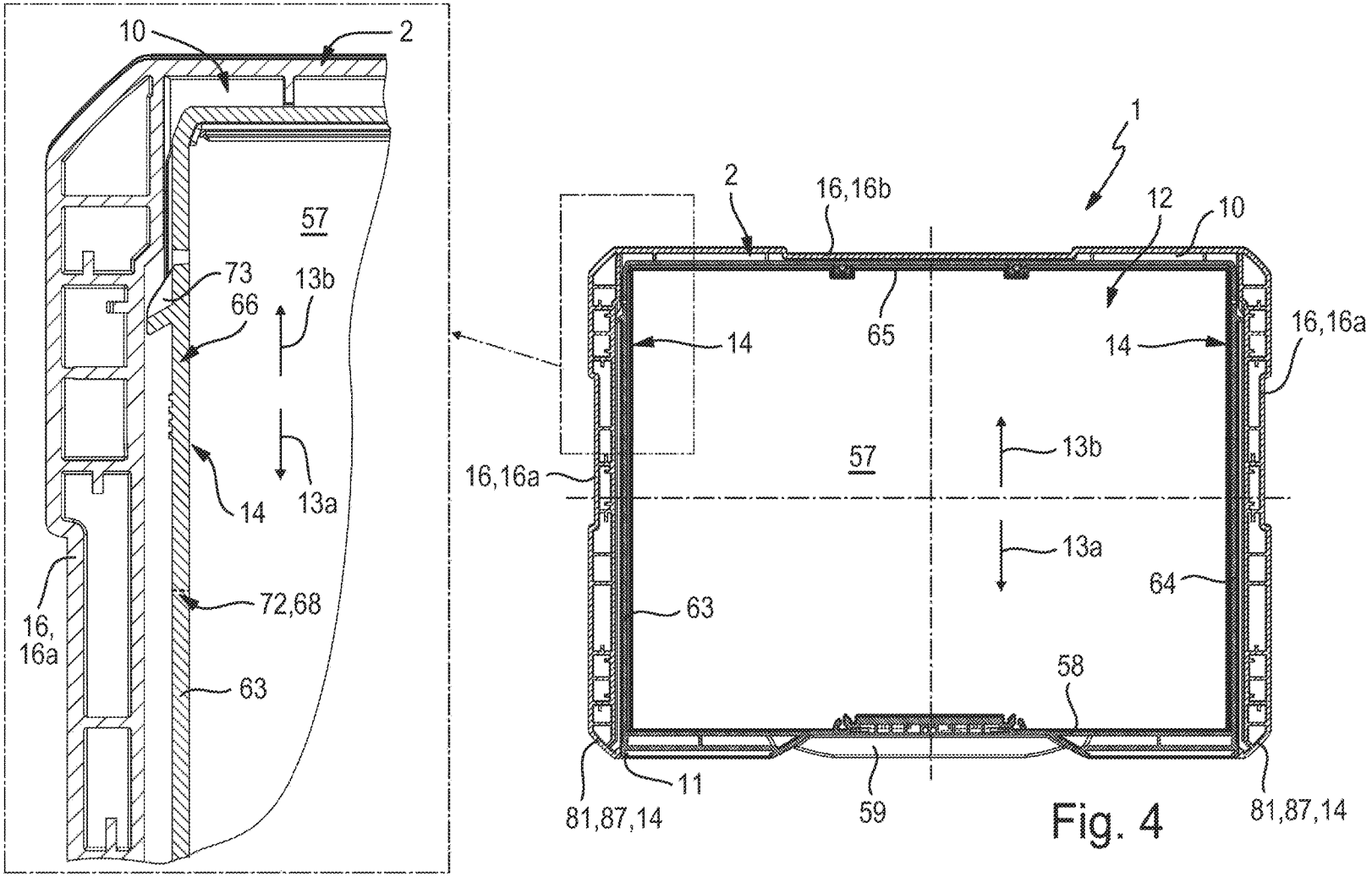
FIG. 4 is a horizontal section through the storage container according to sectional plane IV-IV from FIG. 3, with the illustrated drawer element fully pushed into the associated reception compartment.
Figure 5:
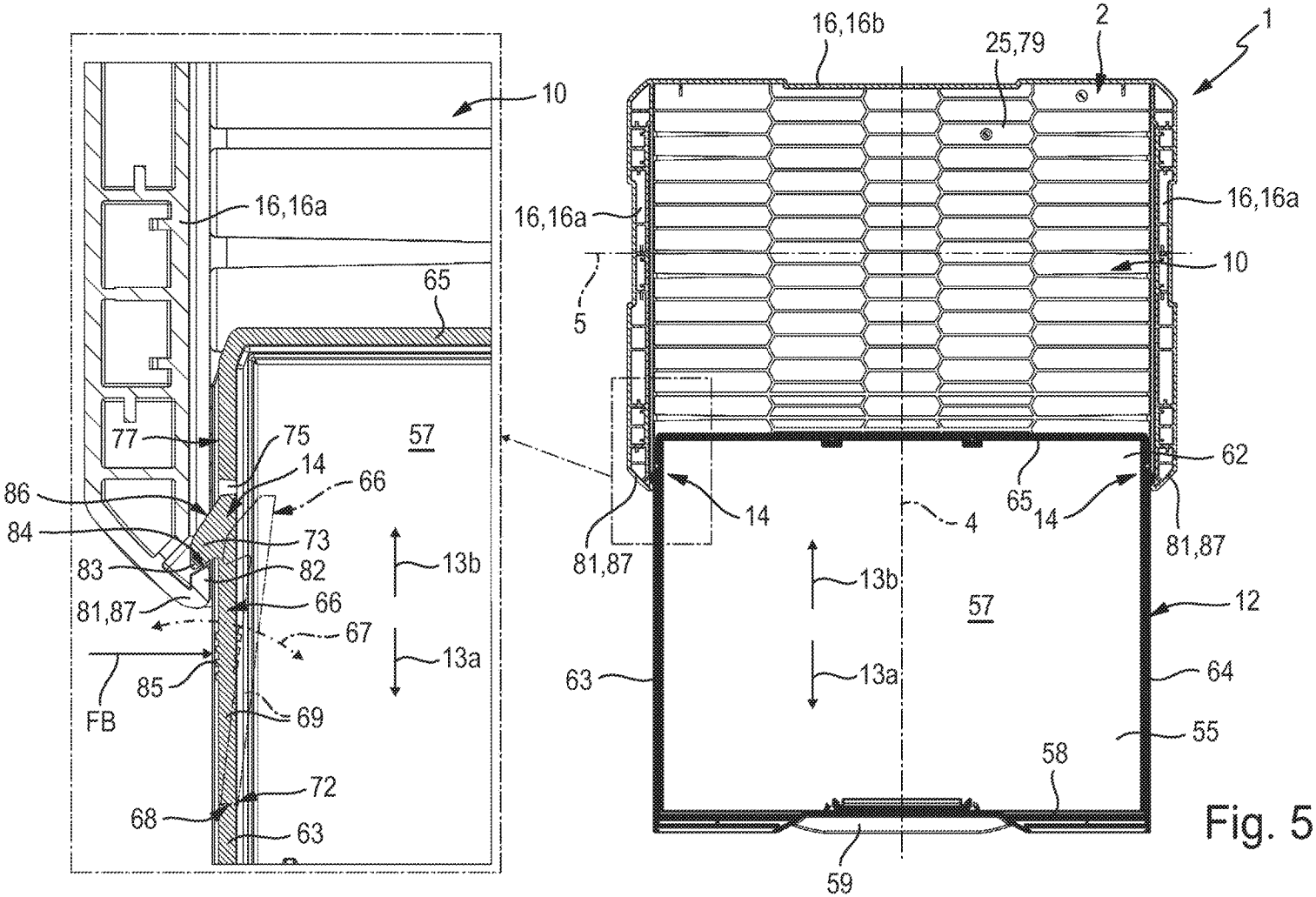
FIG. 5 is a further horizontal section according to sectional plane V-V from FIG. 3, with the assigned drawer element pulled out of the reception compartment to the maximum operating position preset by the pull-out limiting means.
Figure 6:
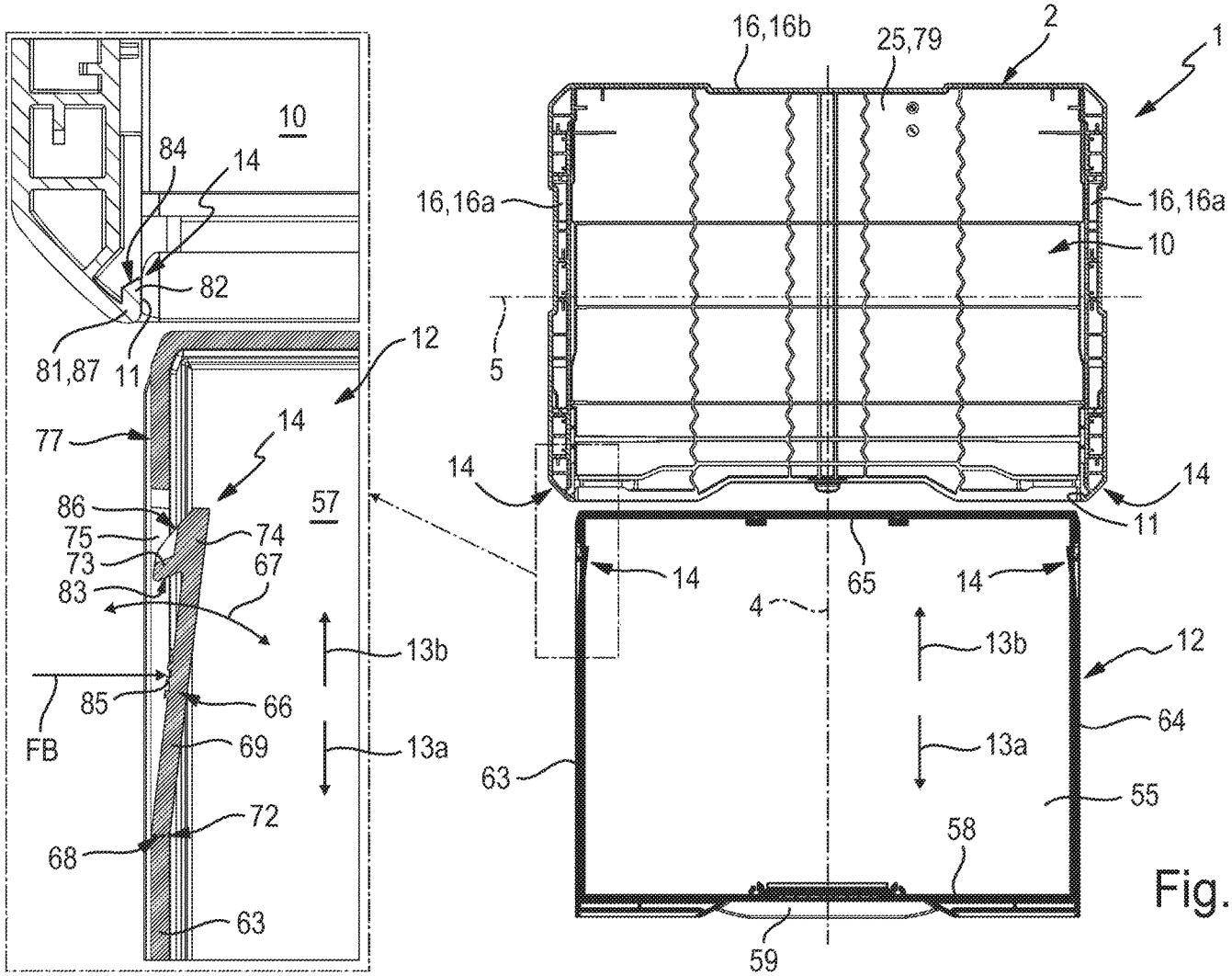
FIG. 6 is a further horizontal section through the storage container according to sectional plane VI-VI from FIG. 3, with the assigned drawer element fully pulled out of the reception compartment and the stop tongues still being in their release position held by manual pressure.
Figure 7:
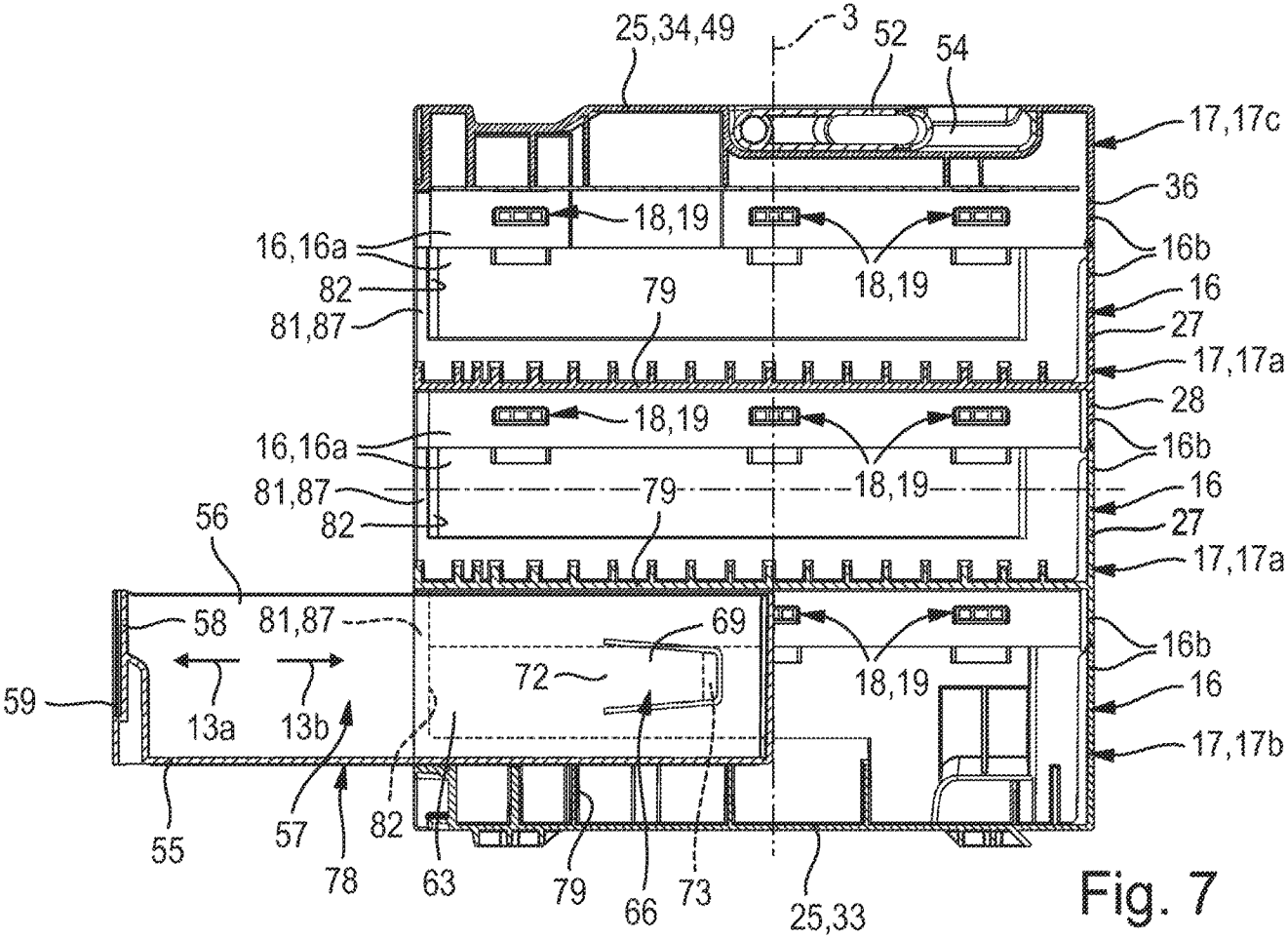
FIG. 7 is a vertical section through the storage container according to sectional plane VII-VII from FIG. 3, with only the lowermost of the several reception compartments shown with a drawer element and the drawer element pulled out partially, but not to the maximum pulled-out operating position.

In FIGS. 2 and 4, the topmost of three drawer elements 12 is shown in the fully pushed-in home position. The middle drawer element 12 placed below is shown in FIGS. 2 and 5 in a position in which it is partially pulled out of the associated reception compartment 10, this position being a maximum pulled-out operating position of the drawer element 12, which is preset by pull-out limiting means 14 to be explained at a later point. The lowermost drawer element 12 is shown in FIGS. 2 and 6 in a position in which it has been completely pulled out of the associated reception compartment 10 and separated from the container housing 2.

For each reception compartment 10, the container housing 2 forms a compartment side wall 16, which bounds the associated reception compartment 10 on the sides which are oriented perpendicular to the vertical axis 3—apart from the region of the compartment opening 11. Each compartment side wall 16—apart from the compartment opening 11 giving access to the drawer element 12—preferably extends as a closed wall around the associated reception compartment 10. Each compartment side wall 16 therefore has two lateral compartment side wall sections 16*a* facing the lateral outsides 8, 9 and a rear compartment side wall section 16*b* located at the rear opposite the compartment opening 11.

In an embodiment not shown in the drawing, the container housing 2 is a one-part design. In particular, it has a single-piece housing body which defines all of the reception compartments provided.

Preferably, however, the container housing 2 has a modular structure. Here it is composed of a plurality of housing modules 17, which are arranged on top of one another in the axial direction of the vertical axis 3 and sit on top of one another. Two housing modules 17 placed immediately adjacent to each other in the height direction 3 are in each case coupled to each other in such a way that relative movement in any spatial direction is impossible. In this way, the coupled housing modules 17 can neither be displaced relative to each other in a horizontal plane perpendicular to the vertical axis 3, nor can the housing modules 17 be lifted off each other in the height direction 3.

The responsibility for the cohesion of the module assembly lies with coupling devices 18 acting between housing modules 17 which are adjacent to one another in the height direction 3. As in the illustrated embodiment, these are preferably designed as latching connection devices 19. During the assembly of the container housing 2, the housing modules 17 can be placed on top of one another in the height direction 3 and partially plugged into one another by applying a defined actuating force, thereby being latched to one another. The latching connection devices 19 are preferably non-releasable, so that an unintentional breaking up of the module assembly can be reliably excluded. In principle, however, it would be possible to design the coupling devices 18 in a manner which allows their decoupling.

Housing modules 17 which are arranged directly on top of one another in the height direction 3 of the container housing 2 together bound one of the reception compartments 10 each. Such housing modules 17 which bound both a reception compartment 10 placed above and a reception compartment 10 placed below shall be described as housing intermediate modules 17*a*. The illustrated embodiment is provided with several such housing intermediate modules 17*a*.

In the region of its underside 23 pointing downwards relative to the axial direction of the vertical axis 3, the modular container housing 2 has a housing module 17 described as lower housing end module 17*b*. In the region of the opposite top side 24, the container housing 2 has a housing module 17 described as upper housing end module 17*c*.

Together with the housing intermediate module 17*a* adjacent in the height direction 3, each housing end module 17*b*, 17*c* bounds a reception compartment 10. If the container housing 2 is to define only one reception compartment 10, there are no housing intermediate modules 17*a*, and the two housing end modules 17*b*, 17*c* are directly fitted to each other, so that they directly and jointly bound the single reception compartment 10.

Each housing module 17 has a module horizontal wall 25, which extends transversely and in particular at right angles to the vertical axis 3. In each housing intermediate module 17*a*, this module horizontal wall 25 forms the base of the reception compartment 10 placed above and at the same time the ceiling of the reception compartment 10 placed below. In the lower housing end module 17*b*, the module horizontal wall 25 forms a lower end wall 33 of the adjacent reception compartment 10, and in the upper housing end module 17*c*, the module horizontal wall 25 forms an upper end wall 34 of the adjacent reception compartment 10. The module horizontal wall 25 expediently has an at least substantially rectangular outline, approximately corresponding to the layout of the container housing 2.

At the edges, two module side walls designated hereinafter as upper module side wall 27 and as lower module side wall 28 for easier differentiation are integrally formed in one piece with the module horizontal wall 25 of at least one housing intermediate module 17*a* and preferably of each housing intermediate module 17*a*. The upper module side wall 27 projects upwards in the height direction 3 from the outer edge of the module horizontal wall 25, while the lower module side wall 28 projects downwards in the height direction 3 from this outer edge 29.

From the outer edge of the lower end wall 33 of the lower housing end module 17*b*, an upper module side wall 35 projects upwards in the height direction 3. In a comparable way, a lower module side wall 36 projects downwards from the outer edge of the upper end wall 34, its circumferential shape corresponding to that of the upper module side wall 35 of the lower end wall 33. If a housing intermediate module 17*a* is provided, its intermediate module side wall 32 likewise has the same circumferential shape as the upper module side wall 35 and the lower module side wall 36.

In the assembled state of the modular container housing 2, the upper module side wall 35 of the lower housing end module 17*b* is supported with its upward-oriented end face 37 in the axial direction of the vertical axis 3 on the downward-oriented end face 37 of the lower module side wall 28 or 34 or of the upper housing end module 17*c* or the housing intermediate module 17*a* placed above. In a comparable way, the lower module side wall 36 of the upper housing end module 17*c* is supported with its downward-oriented end face 37 on the upward-oriented end face 37 of the upper module side wall 27 or 35 of the lower housing end module 17*b* or of the housing intermediate module 17*a* placed immediately below.

The reception compartment 10 bounded by the lower housing end module 17*b* is laterally bounded by a compartment side wall 16 composed of the upper module side wall 35 of the lower housing end module 17*b* and the lower module side wall 36 or 28 of the housing module 17 placed above, the latter being either directly the upper housing end module 17*c* or a housing intermediate module 17*a*.

The reception compartment 10 bounded by the upper housing end module 17*c* is laterally bounded by a compartment side wall 16 composed of the lower module side wall 36 of the upper housing end module 17*c* and the upper module side wall 35 or 27 of the housing module 17 placed below, the latter being either directly the lower housing end module 17*b* or a housing intermediate module 17*a*.

If the storage container 1 is provided with at least one housing intermediate module 17*a*, its intermediate module side wall 32 at the same time forms a part of two compartment side walls 16, these being the compartment side wall 16 of the reception compartment 10 located above the housing intermediate module 17*a* and the compartment side wall 16 of the reception compartment 10 located immediately below the housing intermediate module 17*a*. In other words: with its upper module side wall 27 and its lower module side wall 28, the housing intermediate module 17*a* simultaneously contributes to the formation of the compartment side walls 16 of the reception compartments 10 located above and below the housing intermediate module 17*a*.

In order to ensure that the compartment side wall 16 completely closes off the associated reception compartment 10 irrespective of the multi-part structure in the height direction 3, the housing modules 17 immediately above and below the housing intermediate module 17*a* in the height direction 3 preferably lie with their whole surface on the end face 37 of the associated module side wall 27, 28, which is oriented in the axial direction of the vertical axis 3.

In principle, the upper and lower module side walls 27, 35; 28, 36, which together define a compartment side wall 16, can have the same wall height as measured in the height direction 3 of the container housing 2. In a preferred design, however, which is implemented in all embodiments, the upper and lower module side walls 27, 35; 28, 36 have different wall heights, so that they project to different degrees from the associated module horizontal wall 25 in the height direction 3 of the container housing 2. The upper module side wall 27, 35 is preferably higher than the downward-projecting lower module side wall 28, 36.

The paired coupling between housing modules 17 placed on top of one another is in each case established between the lower module side wall 36, 28 of the respectively upper housing module 17 and the upper module side wall 35, 27 of the housing module 17 placed below. The coupling is established by means of the coupling devices 18 referred to above, which are preferably designed as latching connection devices 19.

In the illustrated storage container 1, latching connection devices 19 of a particularly advantageous design are provided which, for the paired coupling between housing modules 17 adjacent to one another in the vertical direction 3, comprise latching hooks integrally formed on one housing module 17 and latching edges formed on the other housing module for engagement from behind by the latching hooks. By the latching connection devices 19, the housing modules 17 sitting on top of one another are clamped together vertically.

On its top side, the upper housing end module 17*c* is expediently bounded by a cover wall 49, on the upward-oriented outside of which is provided a bow-shaped carrying handle 52, which can be gripped with one hand for transporting the storage container 1. The carrying handle 52 is expediently mounted pivotably on the cover wall 49, the pivot axis 53 preferably extending in the width direction of the container housing 2.

The carrying handle 52 can preferably be folded to the cover wall 49 into a position of non-use, in which it expediently comes to lie in a surface recess 54 of the cover wall 49. For use, the carrying handle 52 can be swivelled into an upright position of use.

In the illustrated embodiment, the upper end wall 34 and the cover wall 49 are one and the same component of the upper housing end module 17*c*. In an embodiment not shown in the drawing, the cover wall 49 is provided in addition to the upper end wall 34 and placed above the latter in the vertical direction 3, acting as a cover plate of an upper housing end module 17*c* designed as a container module.

Each drawer element 12 has a base wall 55, which is preferably plate-shaped. Around the edge of the base wall 55, there extends an outer wall 56, which projects upwards in the axial direction of the vertical axis 3 and, together with the base wall 55, bounds a drawer interior 57 for storing objects. If the drawer element 12 is at least partially pulled out of the associated reception compartment 10 at the front side 6 of the container housing 2, the drawer interior 57 is open towards the top and accessible for placing or removing objects.

The drawer interior 57 can be divided into individual interior sections by means of partitions not illustrated in detail. In addition, the drawer element 12 can have a removable or a pivotably mounted cover.

On the outside—remote from the drawer interior 57—of a front outer wall section 58 of the outer wall 56 of the drawer element 12, which lies in the region of the compartment opening 11 in the fully pushed-in state (FIG. 4), there is expediently provided a handle 59, on which the drawer element 12 can be gripped to pull it out of or to push it back into the reception compartment 10.

The drawer elements 12 expediently consist of a plastic material. The same applies to the container housing 2.

The pull-out limiting means 14 mentioned above are explained in greater detail below. They are used to block the drawer element 12 in a maximum pulled-out operating position when it is pulled out of the reception compartment 10, so that the drawer element 12 cannot accidentally be pulled out of the container housing 2 completely. In this maximum pulled-out operating position, which is illustrated in FIG. 5, most of the length of the drawer element 12 as measured in the axial direction of the longitudinal axis 4 is outside the associated reception compartment 10 and only a rear end section 62 of the drawer element 12, which faces the rear compartment side wall section 16*b*, is still within the reception compartment 10.

A special feature of the pull-out limiting means 14 lies in the fact that they can be intentionally and actively deactivated temporarily in order to facilitate a complete extraction of the drawer element 12 from the associated reception compartment. Such a fully pulled-out state of the drawer element 12 is shown in FIG. 6. In this state, the drawer element 12 can be handled independently of the container housing 2.

The outer wall 56 projecting from the base wall 55 in the height direction 3 has two lateral outer wall sections 63, 64 located at a distance opposite each other in the transverse direction 5 of the container housing 2. Each of these lateral outer wall sections 63, 64 expediently adjoins directly one of the two lateral edge regions of the front outer wall section 58 and extends in the longitudinal direction 4 to the rear end of the drawer element 12. At the rear, the drawer interior 27 is bounded by a rear outer wall section of the outer wall 56, which expediently extends parallel to the front outer wall section 58 and preferably joins the two rear end regions of the two lateral outer wall sections 63, 64 to each other.

Viewed in the axial direction of the vertical axis 3, the outer wall 56 is preferably frame-shaped, extending along the outer edge of the base wall 55.

The pull-out limiting means 14 comprise two stop tongues 66 mounted pivotably on the drawer element 12, one of the stop tongues 66 being assigned to each of the two lateral outer wall sections 63, 64. Relative to the associated two lateral wall section 63, 64, each stop tongue 66 is pivotable in a pivoting plane perpendicular to the vertical axis 3, the pivoting movement performed in this process being indicated in the drawing by a double-headed arrow at 67.

The pivotability of the stop tongues 66 is a result of the fact that each stop tongue 66 is mounted on the associated lateral outer wall section 63, 64 in an elastically deformable manner. The pivoting range of the stop tongues is indicated in the drawing by the reference number 68. Each stop tongue 66 is preferably in itself flexible in a spring-elastic manner.

Figure 8:
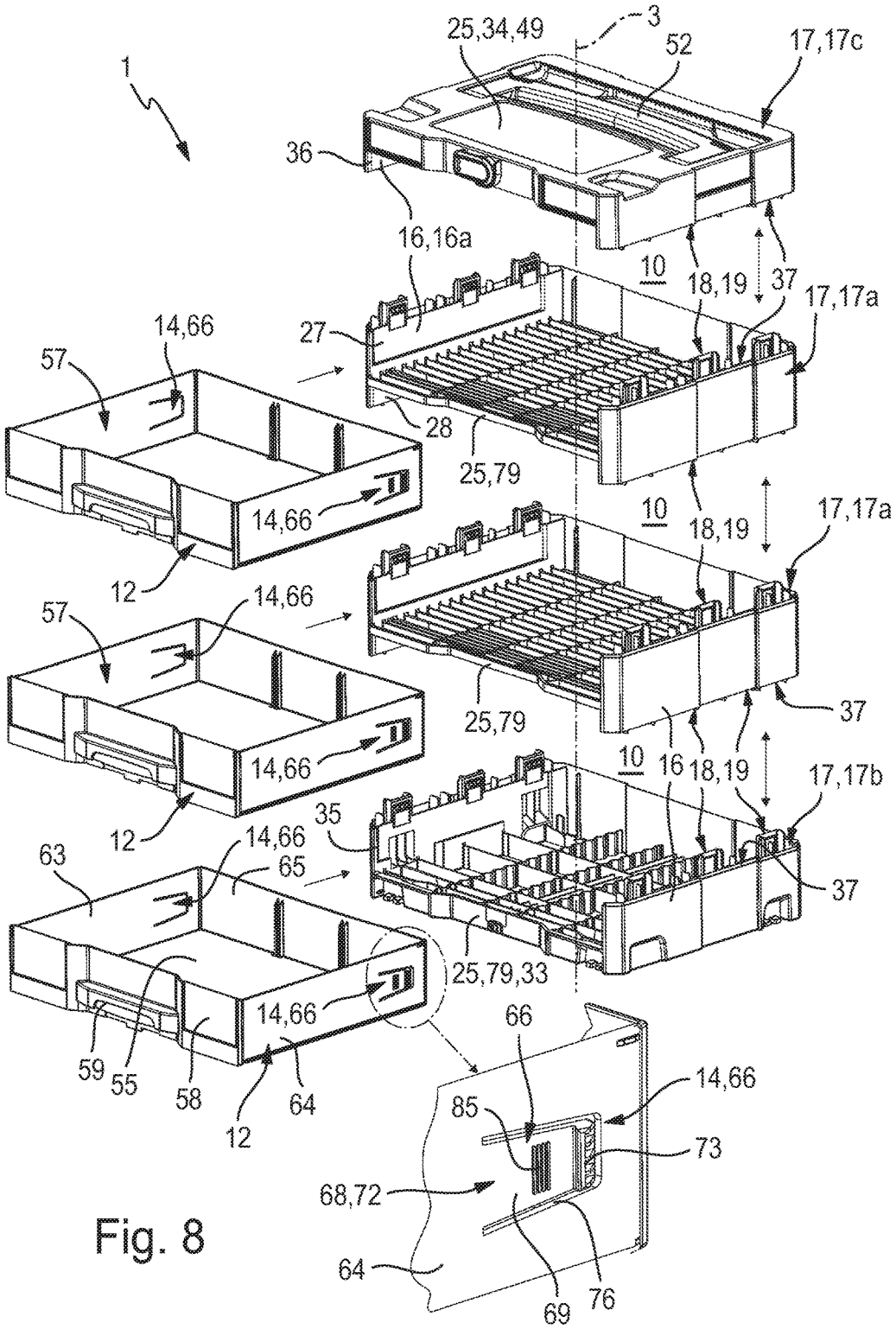
FIG. 8 is an exploded view of the storage container illustrated in the other figures.

In the non-operated state, each stop tongue 66 adopts a non-pivoted home position relative to the associated lateral outer wall section 63, 64 as shown in FIGS. 4, 5 and 8. By the manual application of an operating force FB, each stop tongue 66 can be pivoted into a release position shown in FIG. 6, accompanied by its spring-elastic deformation. The release position is maintained as long as the operating force FB is applied. If the operating force FB is cancelled, the stop tongue 66 returns to the non-pivoted home position owing to the internal elastic tensions built up in the pivoting process.

Each stop tongue 66 has a support arm 69 with a longitudinal extension, whereby one end is connected to the associated lateral outer wall section 63, 64 in a transition region 72. The transition region 72 expediently coincides with the pivoting range 68. At a point distant from the transition region 72 in the longitudinal direction of the support arm 69, the support arm 69 supports a stop projection 73 projecting outwards from the drawer interior 57 in the transverse direction 5. The stop projection 73 projects laterally outwards beyond the support arm 69 and is preferably located at the free end region of the support arm 69 opposite the transition region 72. The stop projection 73 is in particular designed in one piece with the support arm 69.

The stop tongue 66 as a whole is expediently a one-piece plastic body which is in turn integrally joined in one piece to the associated lateral outer wall section 63, 64 in the transition region 72.

Each stop tongue 66 is expediently located on the associated lateral outer wall section 63, 64 within the outline of the respective lateral outer wall section 63, 64 as viewed in the transverse direction 5. It is particularly advantageous if each lateral outer wall section 63, 64 has a wall opening 75, within which the associated stop tongue 66 is located.

Each stop tongue 66 is preferably designed such that its support arm 69, which is preferably plate- or tab-shaped, extends in the wall plane of the associated lateral outer wall section 63, 64 when the stop tongue 66 adopts its non-pivoted home position. This can be seen clearly in FIGS. 4 and 5. The support arm 69 preferably has the same wall thickness as the associated lateral outer wall section 63, 64, which simplifies its production in an injection moulding process.

At the edge of the wall opening 75, the stop tongue 66 is only joined to the lateral outer wall section 63, 64 in the transition region 72. Apart from that, a U-shaped gap 76 extends within the wall opening 75 around the stop tongue 66, this gap 76 being bounded on the outside by that region of the associated lateral outer wall section 63, 64 which surrounds the wall opening 75.

In the non-pivoted home position, the stop projection 73 projects relative to that wall outer surface 77 of the associated lateral outer wall section 63, 64 which is opposite the drawer interior 57.

Each stop tongue 66 is in particular oriented such that it extends from the transition region 72 in the insertion direction 13*b*, i.e. in the illustrated embodiment towards the rear end section 65 of the drawer element 12. Its free end region 74 is therefore oriented towards the rear at the drawer element 12.

The stop tongue 66 is in particular designed such that is tapers conically from the transition region 72 towards its free end region 74. As a result, is has a lesser width in the height direction 3 in the region of the stop projection 73 than in the transition region 72.

In the pull-out and push-in process, the drawer element 12 slides along the compartment base 79 with the downward-oriented base outer surface 78 of the base wall 55. In the illustrated embodiment, each compartment base 79 is formed by a module horizontal wall 25 of a housing module 17. On the top side, the drawer element 12 is only slightly distant from the compartment base 79 placed above, so that is can easily be moved on the one hand but cannot be canted on the other hand. For lateral stabilisation, the lateral outer wall sections 63, 64 of the drawer element 12 can be supported on the inside on the lateral compartment side wall sections 16*a*, 16*b*. There is nevertheless enough play to prevent jamming. There is therefore no need for guide rails. The pull-out limiting means 14 are designed such that the stop tongue 66 does not come into contact with the wall inner surface—facing the reception compartment 10—of the associated lateral compartment side wall section 16*a* either during the pull-out movement 13*a* or during the push-in movement 13*b*. In this way, the operation of the drawer element 12 is not impeded by the stop tongues 66.

The pull-out limiting means 14 further include a number of counter-stop edges 82 fixed in a stationary position on the container housing 2 to match the number of stop tongues 66. One such counter-stop edge 82 is functionally assigned to each stop tongue 66 in such a way that the counter-stop edge 82 is closer to the front side 6 in the longitudinal direction 4 than the stop projection 73 of the respective stop tongue 66 if the drawer element 12 is in the reception compartment 10. In more detail, in the two lateral edge regions of the compartment opening 11, which are oriented in the transverse direction 5, a counter-stop edge 82 each is arranged in such a way that it lies in the pull-out path of the stop projection 73 located on the same side of the drawer element 12.

When the drawer element 12 is pulled out of the associated reception compartment 10, the drawer element 12 can—starting from the fully pushed-in state—initially be pulled out of the container housing 2 without impediment to some degree as indicated by arrow 13*a*. In this way, the drawer element 12 can be moved progressively into any operating positions in which the upward-oriented opening of its drawer interior 57 lies outside the container housing 2 to a greater or lesser degree. The farther the drawer element 12 is pulled out, the greater is the accessible length of the drawer interior 57 as measured in the longitudinal direction 4.

The pull-out limiting means 14 mechanically preset a maximum pulled-out operating position of the drawer element 12, This maximum pulled-out operating position is the result of the stop projections 73 of the two stop tongues 66 running from the interior of the reception compartment 10 against the counter-stop edges 82 on the container housing 2. This state is illustrated in FIG. 5.

In this way, the drawer element 12 is blocked mechanically and an accidental complete extraction from the container housing 2 is impossible.

The counter-stop edges 82 can be realised by means of any suitably positioned structures, which may either be components which are separate from the container housing 2 or—which is preferable—designed in one piece with the container housing 2. In the illustrated embodiment, the two counter-stop edges 82 are defined by the boundary wall sections 81 which laterally bound the compartment opening 11 of the reception compartment 10 in the transverse direction 5.

Each counter-stop edge 82 has a counter-stop face 84, which points towards the interior of the reception compartment 10 and is opposed by a stop face 83 formed on the rear—oriented in the direction of the pull-out movement 13*a*—of the associated stop projection 73. To preset the maximum pulled-out operating position, each of the stop faces 83 hits one of the counter-stop faces 84, thereby stopping any further movement of the drawer element 12.

An advantageous feature of the storage container 1 entails the fact that the user has the opportunity to extract the at least one drawer element 12 completely from the associated reception compartment 10 if required, irrespective of the provision of the pull-out limiting means 14, and then to handle it independently of the container housing 2. A fully pulled-out drawer element 12 can, for example, be deposited in the immediate working area of a workman for fast availability of the tools contained therein.

The possibility of the optional complete extraction from the reception compartment 10 is the result of the spring-elastic pivotability 67 of the stop tongues 66. The reversible elastic flexibility of the stop tongues 66 allows each stop tongue 66 to be pivoted by the manual application of the operating force FB mentioned above from the non-pivoted home position towards the drawer interior into a release position shown in FIG. 6, in which the stop projection 73, if the pull-out movement 13*a* is continued, can move past the associated counter-stop edge 82 without impediment. As a result of this pivoting into the release position, the counter-stop edges 82 no longer lie in the pull-out path of the stop projections 73.

After the stop projections 73 have passed the counter-stop edges 82 when the drawer element 12 is pulled out completely, the manual operating force FB can be cancelled, so that the stop tongues 66 automatically return into the non-pivoted home position as a result of their spring elasticity.

The stop tongues 66 and the counter-stop edges 82 are preferably matched to one another in such a way that a section of the length of the stop tongues 66 comes to lie outside the reception compartment 10 in the maximum pulled-out operating position of the drawer element 12, i.e. is outside the container housing 2 in the region of the front side 6. To pivot them into the release position, a finger of each hand can then easily apply pressure. This advantageous association is provided in the illustrated embodiment and can be seen in FIG. 5.

It is expedient if the user of the storage container 1 receives a clear signal as to the optimum spot for introducing the operating force FB for pivoting the stop tongues 66. For this purpose, the stop tongues 66 are expediently provided with a raised operating structure 85 on the outside of the support arms 69 remote from the drawer interior 57. By way of example, this operating structure 85 is designed in the manner of a fluting and is composed of a plurality of parallel rib-like projections. The operating structure 85 is located in the region between the transition region 72 and the stop projection 73.

To reinsert a fully pulled-out drawer element 12 into the reception compartment 10, the stop tongues 66 are once again temporarily moved into the release position. If the stop projections 73 then have passed the counter-stop edges 82 in the push-in movement 13*b* and the operating force FB has been cancelled, they spring back into the non-pivoted home position, so that they can once again fulfil their pull-out limiting function.

The storage containers 1 of the illustrated embodiment are designed such that the stop tongues 66 are temporarily pivoted into the release position solely by their contact with the container housing 2 while a fully pulled-out drawer element 12 is being pushed in. In this process, the operating force is introduced not at the support arm 69, but directly at the stop projection 73. To make this possible, each stop projection 73 has on the front side pointing in the direction of the push-in movement 13*b* an inclined sliding surface 86 with an inclination having the result that it increasingly diverges from the drawer interior 57 in the pull-out direction of the drawer element 12.

When the completely removed drawer element 12 is inserted into the reception compartment 10, the sliding surfaces 86 of the stop projections 73 come into contact with a counter-stop body 87, which defines the associated counter-stop face 84 and which is preferably the boundary wall section 81 mentioned above of the container housing 2.

When the sliding surfaces 86 come into contact with the counter-stop bodies 87 in the insertion process of the drawer element 12, they slide on the counter-stop bodies 87 while being forced towards the drawer interior 57 until the whole stop projection 73 has finally passed the counter-stop edge 82. Now the operating force caused by the counter-stop body 87 is no longer present, and the stop tongues 66 springs back into the home position.

The pull-out limiting means 14 are preferably designed such that their blocking function cannot be cancelled even by an especially strong pull-out force acting on the drawer element 12. This is achieved by providing that the stop projections 73 are designed to be barb-shaped at their rear side oriented in the pull-out direction and have a stop face 83 which is inclined relative to a plane perpendicular to the longitudinal axis 4. The counter-stop faces 84 of the counter-stop edges 82 are also inclined in the same direction, so that stop projections 73 are locked to the counter-stop edges 82 in the maximum pulled-out operating position. The hooking engagement becomes the stronger the more vigorously the drawer element 12 is pulled. In this way, the unintentional complete withdrawal of the drawer element because of carelessness can be prevented.

The invention claimed is:

1. A storage container comprising a container housing provided with at least one reception compartment open at a compartment opening on a front side of the container housing and with a drawer element arranged in the reception compartment in a manner allowing its pulling-out of and its pushing into the reception compartment in a longitudinal direction of the container housing, wherein the drawer element, in order to form a drawer interior, has a base wall and an outer wall projecting upwards from the base wall and having two lateral outer wall sections located opposite each other at a distance in a transverse direction —perpendicular to the longitudinal direction —of the container housing, and further comprising pull-out limiting means for limiting the pulling-out of the drawer element from the reception compartment, and wherein the pull-out limiting means comprise a stop tongue at each of the two lateral outer wall sections of the drawer element, which can be pivoted by elastic deformation in the transverse direction of the container housing, and which has at least one stop projection projecting in the transverse direction away from the drawer interior towards the outside, and wherein, at the container housing, there is provided in each of the two lateral edge regions of the compartment opening a counter-stop edge located in the pull-out path of one of the stop projections, against which counter-stop edge the associated stop projection can run while the drawer element is pulled out in order to pre-set the maximum pulled-out operating position, wherein the stop tongues by the application of manual force are reversibly pivotable inwards towards the drawer interior into a release position in order to allow the complete removal of the drawer element from the reception compartment, and wherein the counter-stop edges are formed on boundary wall sections of the container housing, which laterally bound the compartment opening of the reception compartment.

2. The storage container according to claim 1, wherein the stop tongues are placed at the lateral outer wall sections in such a way that they come to lie outside the reception compartment with a section of their length in the maximum pulled-out operating position of the drawer element.

3. The storage container according to claim 1, wherein the stop tongues are located within the outline of the associated lateral outer wall section of the drawer element as viewed in the transverse direction.

4. The storage container according to claim 1, wherein each of the stop tongues is located in a wall opening of the associated lateral outer wall section of the drawer element.

5. The storage container according to claim 1, wherein each of the stop tongues has a support arm, which supports the stop projection and is joined in one piece and in an elastically flexible manner to the associated lateral outer wall section of the drawer element in a transition region located at a distance from the stop projection.

6. The storage container according to claim 5, wherein a raised operating structure for the manual application of force is formed on the outside of the support arm remote from the drawer interior between the stop projection and the transition region to the lateral outer wall section.

7. The storage container according to claim 6, wherein the raised operating structure is designed in the manner of a fluting.

8. The storage container according to claim 5, wherein the stop tongue extends from the transition region in the push-in direction of the drawer element.

9. The storage container according to claim 5, wherein each of the stop tongues is located in a wall opening of the associated lateral outer wall section of the drawer element, and wherein the support arm extends within the wall opening in one plane with the associated lateral outer wall section, the stop projection projecting beyond the wall outer surface —remote from the drawer interior —of the lateral outer wall section.

10. The storage container according to claim 5, wherein the stop projection is located at a free end region of the support arm opposite the transition region.

11. The storage container according to claim 1, wherein a handle usable for pulling out the drawer element is located on the outside —remote from the drawer interior —of a front outer wall section of the drawer element, which is assigned to the compartment opening.

12. The storage container according to claim 1, wherein the container housing comprises a plurality of reception compartments placed on top of one another in the height direction of the container housing, each containing a drawer element provided with pull-out limiting means.

13. The storage container according to claim 1, wherein the container housing has a modular structure and comprises a plurality of housing modules arranged on top of one another in the height direction of the container housing and coupled to one another in pairs in a way which prevents lifting off from each other, wherein two housing modules arranged immediately on top of each other in each case jointly define a reception compartment for a drawer element.

14. The storage container according to claim 13, wherein at least one or each of the reception compartments is laterally bounded by a compartment side wall, which is formed by the container housing and which comprises an upward-projecting upper module side wall of a lower housing module and a downward-projecting lower module side wall of an upper housing module located on top of this lower housing module in the height direction and latched thereto in a way which prevents lifting off.

15. The storage container according to claim 1, wherein the container housing comprises a plurality of reception compartments, each bounded by two housing modules placed immediately on top of each other, for a pull-out and push-in drawer element each, wherein at least one or each of the housing modules located between two reception compartments is designed as a housing intermediate module having a module horizontal wall extending between the two reception compartments at right angles to the height direction and an upward-projecting upper module side wall formed in one piece with the module horizontal wall at the edge thereof as well as a lower module side wall formed in one piece with the module horizontal wall at the edge thereof and projecting beyond the module horizontal wall in the downward direction in such a way that the housing intermediate module contributes to the formation of both a compartment side wall laterally bounding the reception compartment placed above the housing intermediate module and a compartment side wall laterally bounding the reception compartment placed below.

16. A storage container comprising a container housing provided with at least one reception compartment open at a compartment opening on a front side of the container housing and with a drawer element arranged in the reception compartment in a manner allowing its pulling-out of and its pushing into the reception compartment in a longitudinal direction of the container housing, wherein the drawer element, in order to form a drawer interior, has a base wall and an outer wall projecting upwards from the base wall and having two lateral outer wall sections located opposite each other at a distance in a transverse direction —perpendicular to the longitudinal direction —of the container housing, and further comprising pull-out limiting means for limiting the pulling-out of the drawer element from the reception compartment, and wherein the pull-out limiting means comprise a stop tongue at each of the two lateral outer wall sections of the drawer element, which can be pivoted by elastic deformation in the transverse direction of the container housing, and which has at least one stop projection projecting in the transverse direction away from the drawer interior towards the outside, and wherein, at the container housing, there is provided in each of the two lateral edge regions of the compartment opening a counter-stop edge located in the pull-out path of one of the stop projections, against which counter-stop edge the associated stop projection can run while the drawer element is pulled out in order to pre-set the maximum pulled-out operating position, wherein the stop tongues by the application of manual force are reversibly pivotable inwards towards the drawer interior into a release position in order to allow the complete removal of the drawer element from the reception compartment, and wherein the stop projections are designed to be barb-shaped at their rear side oriented in the pull-out direction of the drawer element and therefore have an inclined stop face at the rear, the counter-stop edges having correspondingly inclined counter-stop faces, so that the stop projections are hooked to the counter-stop edges in the maximum pulled-out operating position of the drawer element.

17. A storage container comprising a container housing provided with at least one reception compartment open at a compartment opening on a front side of the container housing and with a drawer element arranged in the reception compartment in a manner allowing its pulling-out of and its pushing into the reception compartment in a longitudinal direction of the container housing, wherein the drawer element, in order to form a drawer interior, has a base wall and an outer wall projecting upwards from the base wall and having two lateral outer wall sections located opposite each other at a distance in a transverse direction —perpendicular to the longitudinal direction —of the container housing, and further comprising pull-out limiting means for limiting the pulling-out of the drawer element from the reception compartment, and wherein the pull-out limiting means comprise a stop tongue at each of the two lateral outer wall sections of the drawer element, which can be pivoted by elastic deformation in the transverse direction of the container housing, and which has at least one stop projection projecting in the transverse direction away from the drawer interior towards the outside, and wherein, at the container housing, there is provided in each of the two lateral edge regions of the compartment opening a counter-stop edge located in the pull-out path of one of the stop projections, against which counter-stop edge the associated stop projection can run while the drawer element is pulled out in order to pre-set the maximum pulled-out operating position, wherein the stop tongues by the application of manual force are reversibly pivotable inwards towards the drawer interior into a release position in order to allow the complete removal of the drawer element from the reception compartment, and wherein the stop projections have, on their front side oriented in the push-in direction of the drawer element, an inclined sliding surface, which increasingly diverges from the drawer interior in the pull-out direction of the drawer element and which can slide on a counter-stop body which is stationary relative to the container housing while the pulled-out drawer element is inserted into the reception compartment, whereby the associated stop tongue can be pivoted reversibly inwards towards the drawer interior into a release position without any direct application of manual force until the stop projection has passed the counter-stop edge.

18. A storage container comprising a container housing provided with at least one reception compartment open at a compartment opening on a front side of the container housing and with a drawer element arranged in the reception compartment in a manner allowing its pulling-out of and its pushing into the reception compartment in a longitudinal direction of the container housing, wherein the drawer element, in order to form a drawer interior, has a base wall and an outer wall projecting upwards from the base wall and having two lateral outer wall sections located opposite each other at a distance in a transverse direction —perpendicular to the longitudinal direction—of the container housing , and further comprising pull-out limiting means for limiting the pulling-out of the drawer element from the reception compartment, wherein the pull-out limiting means comprise a stop tongue at each of the two lateral outer wall sections of the drawer element which can be pivoted by elastic deformation in the transverse direction of the container housing and which has at least one stop projection projecting in the transverse direction away from the drawer interior towards the outside, and in that at the container housing there is provided in each of the two lateral edge regions of the compartment opening a counter-stop edge located in the pull-out path of one of the stop projections, against which counter-stop edge the associated stop projection can run while the drawer element is pulled out in order to pre-set the maximum pulled-out operating position, wherein the stop tongues by the application of manual force are reversibly pivotable inwards towards the drawer interior into a release position in order to allow the complete removal of the drawer element from the reception compartment, wherein the stop tongues are placed at the lateral outer wall sections in such a way that they come to lie outside the reception compartment with a section of their length in the maximum pulled-out operating position of the drawer element, wherein each of the stop tongues has a support arm, which supports the stop projection and is joined in one piece and in an elastically flexible manner to the associated lateral outer wall section of the drawer element in a transition region located at a distance from the stop projection, wherein the stop tongue extends from the transition region in the push-in direction of the drawer element.

* * * * *